US007670198B2

(12) United States Patent
Shimizu

(10) Patent No.: US 7,670,198 B2
(45) Date of Patent: Mar. 2, 2010

(54) TERMINAL FITTING

(75) Inventor: Tooru Shimizu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/263,523

(22) Filed: Nov. 3, 2008

(65) Prior Publication Data

US 2009/0117773 A1 May 7, 2009

(30) Foreign Application Priority Data

Nov. 5, 2007 (JP) ..... 2007-287312
Nov. 8, 2007 (JP) ..... 2007-290971

(51) Int. Cl.
*H01R 11/12* (2006.01)

(52) U.S. Cl. ..... 439/852

(58) Field of Classification Search ..... 439/871, 439/872, 595

See application file for complete search history.

(56) References Cited

U.S. PATENT DOCUMENTS 6,183,312 B1 * 2/2001 Yamamoto ..... 439/748
6,520,801 B2 * 2/2003 Tabata et al. ..... 439/595
6,679,738 B2 * 1/2004 Nimura ..... 439/852

FOREIGN PATENT DOCUMENTS

JP 2003-068385 3/2003

* cited by examiner

*Primary Examiner*—Ross N Gushi
(74) *Attorney, Agent, or Firm*—Gerald E. Hespos; Anthony J. Casella

(57) ABSTRACT

A terminal fitting (1) has a rectangular tubular main portion (10) and a stabilizer (30) to guide the main portion (10) into a cavity formed in a connector housing. The stabilizer (30) is folded between two adjacent walls (13, 14) of the main portion (10) so that the stabilizer (30) is integral to each of the adjacent walls (13, 14).

10 Claims, 10 Drawing Sheets

TERMINAL FITTING

BACKGROUND OF THE INVENTION

1. Field of the Invention

The invention relates to a terminal fitting.

2. Description of the Related Art

Japanese Unexamined Patent Publication No. 2003-68385 discloses a terminal fitting with a rectangular tubular main portion that extends in forward and backward directions. The main portion is configured to be inserted forwardly into a cavity. A stabilizer is formed integral to a side wall of the main portion and is folded. The stabilizer functions to guide the main portion into the cavity. A force on the stabilizer is intended to be distributed to the side wall to prevent deformation of the stabilizer.

Part of the above-described stabilizer is connected with the side wall of the main portion, but an end edge of the stabilizer is not supported at all. Thus, a strong force could deform the stabilizer. A locking lance may engage the rear end of the stabilizer to retain the terminal fitting in the cavity. However, a deformable stabilizer may not provide sufficient locking force on the terminal.

The invention was developed in view of the above and an object thereof is to form a stabilizer with high rigidity so that a sufficient locking force can be obtained even if a locking lance is engaged with the rear end of the stabilizer.

SUMMARY OF THE INVENTION

The invention relates to a terminal fitting with a main portion that extends substantially in forward and backward directions. The main portion can be inserted into a cavity in a connector housing. The terminal fitting also has at least one stabilizer that can be inserted into an insertion groove formed in an inner surface of the cavity of the connector housing for guiding insertion of the main portion when the main portion. The stabilizer is formed by folding a portion of surrounding walls of the main portion while being integral to adjacent portions thereof and comprises a fold to be inserted into the insertion groove in the cavity.

The stabilizer preferably is folded between two adjacent walls of the main portion and opposite sides of the stabilizer are integral or unitary with the walls.

The main portion preferably is a rectangular tube that extends in forward and backward directions. The stabilizer preferably is folded between two adjacent walls of the rectangular tubular main portion and opposite sides of the stabilizer are integral or unitary with two adjacent walls of the main portion. Accordingly, forces on the stabilizer are distributed to the two walls that are integral or unitary with the folded stabilizer. Thus, the rigidity of the stabilizer is increased as compared with the case where the stabilizer is integral with only one wall. Therefore, a sufficient locking force can be obtained if the terminal fitting is retained by the engagement of a locking lance with the stabilizer.

A lock may be provided at or close to an edge of one of the walls substantially opposite to the stabilizer. An engageable portion may be provided at another wall for engaging the lock in forward and/or backward directions.

One of the walls may include inner and outer wall panels. The inner wall panel may be connected with the stabilizer. Accordingly, the outer wall panel prevents deformation of the inner wall panel even if a force is applied on the stabilizer.

A resilient contact may be provided on the main portion for contacting a mating terminal fitting. The resilient contact may be behind one of the walls that is continuous with the stabilizer in an unfolded state of the main portion before being bent. Terminal fittings are arranged side by side in an unfolded state. Accordingly, an interval between adjacent terminal fittings can be made smaller than in the case where the resilient contact piece is arranged lateral to the one wall in the unfolded state. Therefore, the number of terminal fittings taken from a sheet metal can be increased to improve a yield.

The stabilizer may project from the outer surface of one wall of the main portion. A lock may be at one side of the stabilizer and an engageable portion may be on one of the walls of the main portion for engaging the lock. The engagement of the lock with the engageable portion prevents forward movement of the stabilizer. Accordingly, one side of the stabilizer can be integral or unitary to one wall of the main portion and an opposite side of the stabilizer can be supported by the engagement of the lock with the engageable portion. Thus, the stabilizer is highly rigid, and a sufficient locking force can be obtained, for example, in the case of retaining the terminal fitting by the engagement of a locking lance with the rear end of the stabilizer.

Backward movement of the stabilizer may be prevented by engaging the rear end of the lock with the engageable portion. Accordingly, the stabilizer can be prevented from being buckled and deformed, for example, if the terminal fitting is inserted in a vertically inverted posture into the cavity from behind and the front end of the stabilizer comes into contact with the rear opening edge of the cavity or the like.

The lock may include at least one cutout and the engageable portion may include a projection that fits in the cutout to prevent backward movement of the stabilizer. The rear end of the projection may be located before the rear end of the stabilizer. Accordingly, the projection will not interfere with the locking lance. In other words, it is not necessary to form a smaller locking lance to avoid interference with the projection and a larger locking force can be obtained by engaging the large locking lance with the rear end of the stabilizer.

At least one long hole may penetrate an edge of the one wall of the main portion, and the engageable portion may be formed by the opening edge of the long hole. Thus, the locking portion and the engageable portion can be engaged by fitting the extending end of the stabilizer into the long hole.

The stabilizer may have a substantially triangular, pointed or converging shape with a fold at a laterally intermediate position. Accordingly, a distance from an axial center passing in forward and backward directions in the interior of the main portion to the fold of the stabilizer can be minimized. Thus, the interference of the fold and an inner circumferential surface of a round hole can be minimized upon inserting the terminal fitting into the round hole.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
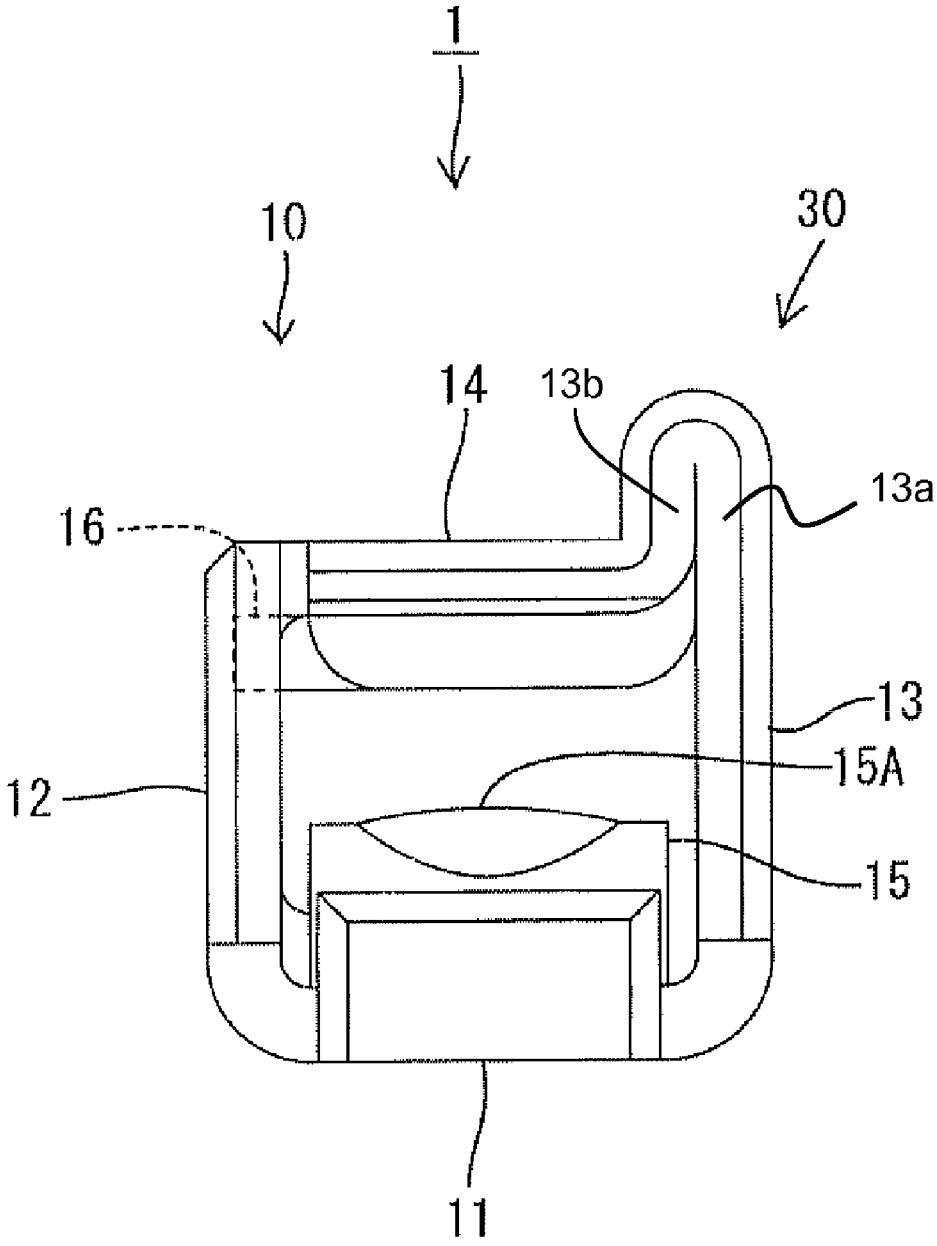
FIG. 1 is a front view when a terminal fitting according to one embodiment is viewed from front.
Figure 2:
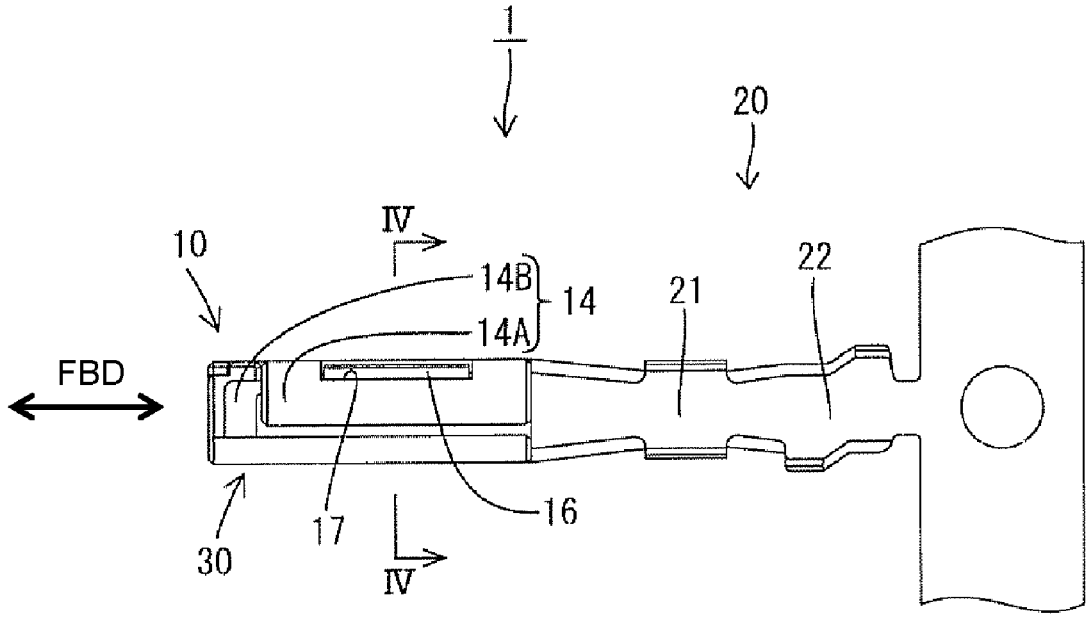
FIG. 2 is a plan view when the terminal fitting is viewed from above.
Figure 3:
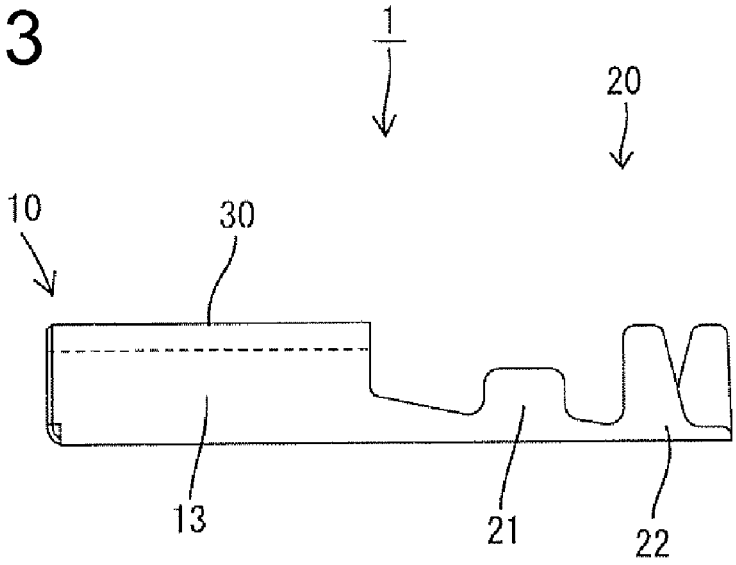
FIG. 3 is a side view when the terminal fitting is viewed sideways.

A terminal fitting in accordance with a first embodiment of the invention is identified by the numeral 1 in FIGS. 1 to 5. The terminal fitting 1 of this embodiment has a substantially rectangular tubular main portion 10 that extends in forward and backward directions FBD. A wire connection barrel 20 is continuous with the rear end of the main portion 10 and a stabilizer 30 is formed at an outer corner of the main portion 10. In the following description, reference is made to FIG. 1 concerning vertical and lateral directions.

The barrel portion 20 includes a wire barrel 21 to be crimped, bent or folded into connection with a core of a wire end (not shown) and an insulation barrel 22 to be crimped, bent or folded into connection with an insulated part of the wire end, such as a wire coating. The insulation barrel 22 is behind the wire barrel 21 and includes crimping pieces displaced from each other in forward and backward directions FBD.

As shown in FIG. 1, the main portion 10 is comprised of a bottom wall 11, a left wall 12 that projects substantially normal from the left side of the bottom wall 11, a right wall 13 that projects substantially normal from the right side of the bottom wall 11 and an upper wall 14 arranged between the upper ends of the left and right walls 12 and 13 to face the bottom wall 11. The upper wall 14 has an inner panel 14A arranged at the inner side of the main portion 10 and an outer panel 14B arranged at the outer side of the main portion 10.

A resilient contact piece 15 extends forwardly into the main portion 10 from the rear end of the inner panel 14A and is resiliently deformable up and down. A contact 15A is embossed to project up and in at a position near the front end of the resilient contact piece 15. The contact 15A can resiliently contact a male tab (not shown) of a mating terminal fitting inserted into the main portion 10 through a front end opening. More particularly, the male tab slides along the contact 15A and presses the resilient contact piece 15 out and towards the bottom wall 11. Thus, the male tab is held tightly between the contact 15A and the inner panel 14A to achieve electrical connection between the mating terminal fitting and the terminal fitting 1.

A lock 16 projects laterally to the left at the left edge of the inner panel 14A. On the other hand, a locking hole 17 is formed in a part connecting the outer panel 14B and the left wall 12. The lock 16 is fit into the locking hole 17 when the inner panel 14A is bent towards the upper edge of the left wall 12 during the bending of the main portion 10 from an unfolded state. The front and rear edges of the lock 16 engage the front and rear inner peripheral edges of the locking hole 17 to prevent the inner panel 14A is from moving in forward and backward directions (FBD). Subsequently, the outer panel 14B is bent towards the upper edge of the right wall 13 so that the lower surface of the outer panel 14B is placed substantially in surface contact with the upper surface of the inner panel 14A to prevent the inner panel 14A from being deformed towards the outer panel 14B.

The terminal fitting 1 preferably is inserted into a waterproof mat seal. Accordingly, the outer peripheral edge of the front surface of the main portion 10 is beveled to prevent the waterproof mat seal from being scratched. Similar to the main portion 10, the outer peripheral edge of the stabilizer 30 continuous with the main portion 10 preferably also is beveled. The stabilizer 30 is substantially formed with an R-surface by being bent.

The stabilizer 30 extends up and out from the upper end of the right wall 13 in a direction substantially parallel to the right wall 13. The stabilizer 30 then is folded to define a fold 30F and extends down from the fold 30F towards the upper panel 14. The extending end of the stabilizer 30 is connected unitarily with the right side of the inner panel 14A. Thus, the stabilizer 30 has two bottom ends connected unitarily with the upper end of the right wall 13 and the right side of the inner panel 14A. Accordingly, the stabilizer 30 is a unitary extension of both the right wall 13 and the inner panel 14A. In other words, the stabilizer 30 is formed at an intermediate portion IP of the main portion 10 between the adjacent walls 13 and 14 and is unitary with the adjacent walls 13 and 14. Further, the stabilizer 30 has substantially the same dimension in forward and backward directions FBD as the right wall 13 and is flush with the right wall 13. The terminal fitting 1 is inserted into a cavity. A locking lance (not shown) is provided at an inner surface of the cavity and engages the rear end of the stabilizer 30 to prevent the terminal fitting 1 from coming out backward.

The wire connected with the terminal fitting 1 could be pulled backward after the terminal fitting 1 is inserted into the cavity. As a result, the locking lance will exert a strong force on the stabilizer 30. However, the stabilizer 30 of this embodiment is folded closely at the fold 30F so that the two panels 13*a* and 13*b* of the stabilizer 30 are arranged closely. As a result, the stabilizer 30 is rigid and a force exerted by the locking lance on the rear end of the stabilizer 30 will not cause the stabilizer 30 to deform. Therefore, a locking force of the locking lance can be increased.

Figure 5:
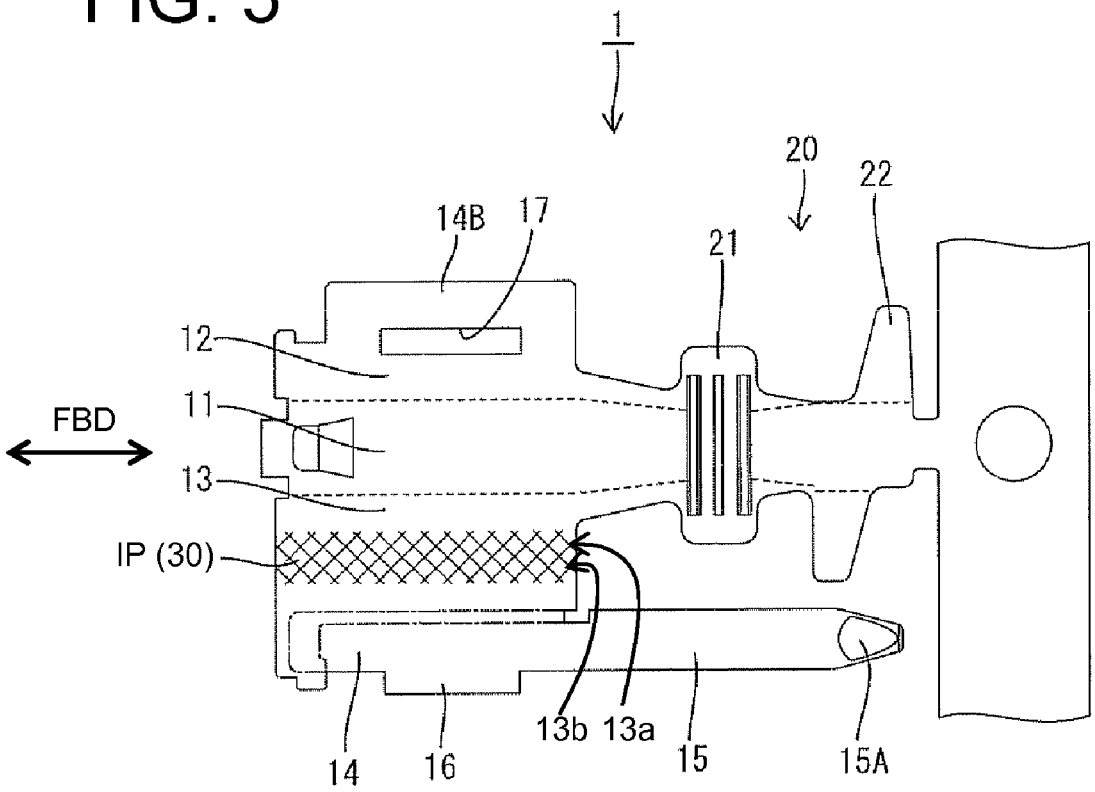
FIG. 5 is a plan view of a blank for forming the terminal fitting.

The terminal fitting 1 is formed by bending, folding and/or embossing a unitary blank of conductive sheet material, as illustrated in FIG. 5. The blank is configured so that left wall 12 is unitary with the outer panel 14B of the upper wall 14, as shown near the top of FIG. 5. The right wall 13, the stabilizer 30 and the inner panel 14A of the upper wall 14 are substantially continuous with the bottom wall 11 near the bottom in FIG. 5. The resilient contact piece 15 is arranged behind the inner panel 14A.

Figure 6:
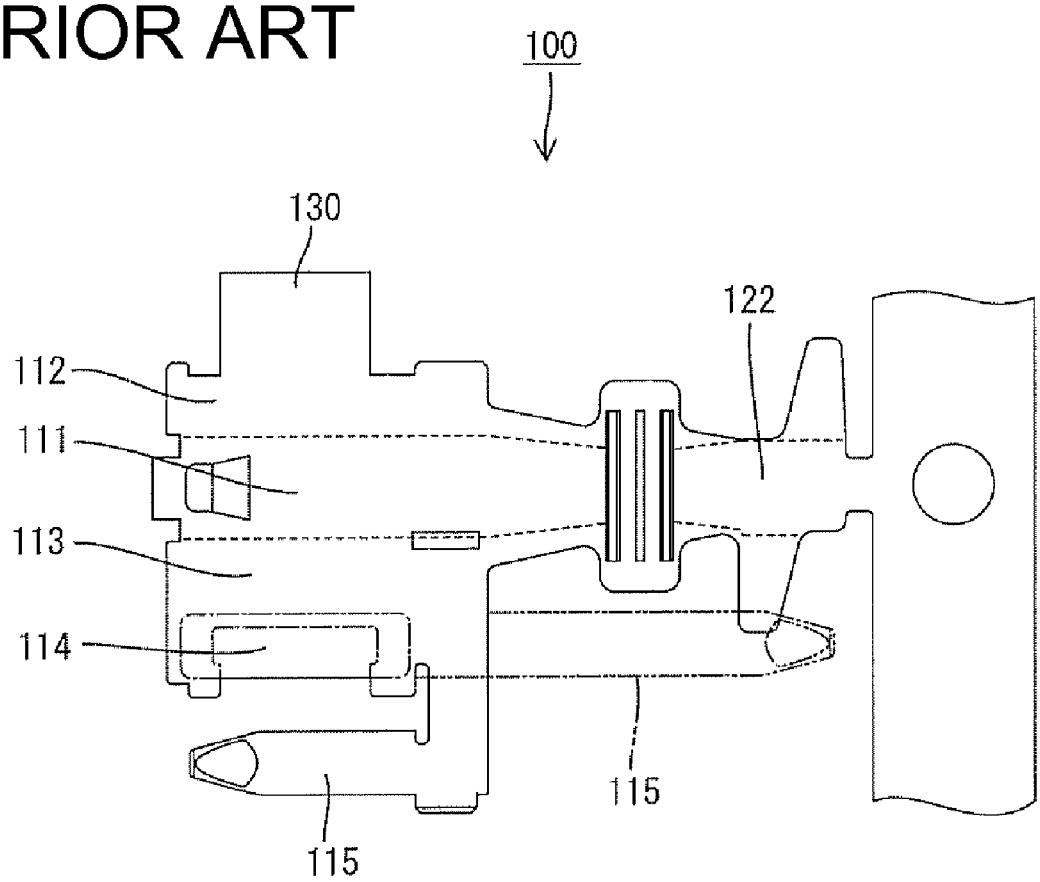
FIG. 6 PRIOR ART
FIG. 6 is a plan view of a blank for a conventional terminal fitting.

FIG. 6, on the other hand, shows the unfolded blank 100 of a conventional prior art terminal fitting. The prior art blank 100 has a left wall 112 continuous with a bottom wall 111 near the top of FIG. 6. A right wall 113 and an upper wall 114 are continuous with the bottom wall 111 near the bottom of FIG. 6. A stabilizer 130 is arranged above the left wall 112 in FIG. 6, and a resilient contact piece 115 is arranged below the upper wall 114 in FIG. 6.

The blank 100 of the prior art terminal fitting differs from the blank for the terminal fitting 1 of this embodiment in that the resilient contact piece 115 is arranged below the upper wall 114 in FIG. 6 and the stabilizer 130 is arranged above the left wall 112 in FIG. 6. Accordingly, the resilient contact piece 115 and the upper wall 114 in FIG. 6 are spaced apart along an arrangement direction of adjacent blanks 100 of the prior art. As a result, an interval between adjacent prior art blanks 100 is larger as compared with the case where the resilient contact piece 15 is to the right of the inner wall 14A in FIG. 5 of this embodiment. An attempt might be considered to arrange the resilient contact piece 115 to the right of the upper wall 114 in the prior art blank 100 in FIG. 6. However, such a redesign of the prior art blank 100 would cause the resilient contact piece 115 to interfere with an insulation barrel 122, as shown by chain double-dashed line in FIG. 6. Accordingly, the resilient contact piece 115 can be arranged only below the upper wall 114 in FIG. 6 and the interval between adjacent prior art blanks 100 cannot be narrowed.

On the other hand, the stabilizer 30 is arranged between the right wall 13 and the inner panel 14A in this embodiment. Thus, the resilient contact piece 15 can be arranged to the right of the inner panel 14A in FIG. 5 while avoiding the interference of the resilient contact piece 15 and the insulation barrel 22. In other words, the stabilizer 30 is formed at an intermediate portion IP of the surrounding wall of the main portion 10 between the adjacent walls 13 and 14. Therefore, in this embodiment the interval between adjacent terminal fittings 1 can be made smaller than in the prior art of FIG. 6.

The terminal fitting 1 is formed by bending, folding and/or embossing a conductive metal sheet that has been cut, stamped or punched-out to form the unfolded blank shown in FIG. 5. The front edge of the blank at the left side of FIG. 5 is chamfered along the surface of the blank that will define the outer side of the terminal fitting 1. Parts of the blank on the opposite sides of the bottom wall 11 are bent up to define left and right walls 12 and 13 that extend substantially normal to the bottom wall 11. A part of the blank extending unitarily up from the upper end of the right wall 13 is folded closely in at an intermediate position 30F to form the stabilizer 30 with panels 13*a*, 13*b* that are in substantially face to face relationship. The panel 13*a* is substantially coplanar with the right wall 13. A part of the blank at the bottom of the panel 13*b* of the stabilizer 30 is bent towards the left wall 12 to form the inner panel 14A of the upper wall 14. The lock 16 is defined at the edge of the inner panel 14A opposite the stabilizer 30 and is fit into the locking hole 17 at the top of the left wall 12. Thereafter, an upper end part of the left wall 12 is bent towards the right wall 13 to form the outer panel 14B of the upper wall 14.

The terminal fitting 1 can be inserted into a cavity of a connector housing. During the insertion operation, the stabilizer 30 slides along an insertion groove in the cavity and guides the main portion 10 into the cavity in a proper orientation. A locking lance in the cavity engages the rear end of the stabilizer 30 when the terminal fitting 1 reaches the proper insertion position to retain the terminal fitting 1 in the cavity.

The stabilizer 30 will be pressed against the locking lance if the wire connected with the terminal fitting 1 is pulled backward after the terminal fitting is mounted in the cavity. However, the stabilizer 30 is unitary to both the right wall 13 and the inner panel 14A and will not be deformed in response to forces against the locking lance. The inner panel 14A is unitary with the stabilizer 30 and has the locking edge 16 that engages the inner peripheral surface of the locking hole 17. Thus, both the inner panel 14A and the stabilizer 30 are prevented from moving in forward and/or backward directions (FBD). Forces exerted on the stabilizer 30 are transmitted to the inner panel 14A. However, the outer panel 14B is arranged against the outer surface of the inner panel 14A and prevents the inner panel 14A from being deformed outwardly in response to the forces on the stabilizer 30. Further, the stabilizer 30 has the same thickness and length as the right wall 13 and is flush with the right wall 13. Thus, forces on the stabilizer 30 are supported by both the right panel 13*b* of the stabilizer 30 and the right wall 13. As a result, forces acting on the stabilizer 30 are resisted more effectively. Rigidity of the stabilizer 30 is increased by the closely folded construction. Thus, a sufficient locking force of the locking lance on the rear end of the stabilizer 30 is ensured and the terminal fitting 1 is prevented from coming out backward from the cavity. The stabilizer 30 of this embodiment has both a guiding function and a retaining function for the terminal fitting 1. Therefore, it is not necessary to provide separate structures for these functions and the construction can be simplified as a whole.

As described above, opposite sides of the folded stabilizer 30 are unitary to both the right wall 13 and the inner panel 14A of the upper wall 14. Thus, forces acting on the stabilizer 30 are distributed to the respective walls 13, 14. Accordingly, the rigidity of the stabilizer 30 is increased as compared with the case where a stabilizer is formed integral or unitary to a single wall. Thus, a sufficient locking force can be obtained between the locking lance and the rear end of the stabilizer 30 for retaining the terminal fitting 1.

The lock 16 engages the inner peripheral surface of the locking hole 17 in forward and backward directions FBD to increase the strength of the stabilizer 30 against forces acting in forward and backward directions FBD. Simultaneously, the outer panel 14B prevents the inner panel 14A from being deformed outwardly in response to a force on the stabilizer 30. Further, the resilient contact piece 15 is arranged behind the inner panel 14A in the unfolded state. Thus, an interval between adjacent terminal fittings 1 can be made smaller than in the case where the resilient contact piece 15 is arranged lateral to the inner panel 14A. Therefore, the number of terminal fittings 1 taken from a sheet metal can be increased to improve a yield.

The present invention is not limited to the above described and illustrated embodiment. For example, the following modifications are also embraced by the technical scope of the present invention.

The stabilizer 30 is formed between the right wall 13 and the inner panel 14A of the upper wall 14 in this embodiment. However, the stabilizer may be formed between any two adjacent walls according to the present invention. For example, the stabilizer 30 may be formed between the bottom wall 11 and the right wall 13.

The stabilizer 30 is closely bent in the above embodiment. However, it is sufficient to form the stabilizer 30 by folding even if the stabilizer 30 is not closely bent. Although the stabilizer 30 is substantially flush with the right wall 13 in the above embodiment, it may not be flush with the inner panel 14A and the right wall 13 according to the present invention.

The terminal fitting 1 is retained by the engagement of the locking lance with the rear end of the stabilizer 30 in the above embodiment. However, the stabilizer 30 may not perform the function of retaining the terminal fitting 1.

The lock 16 engages the locking hole 17 to prevent movements of the inner panel 14A along forward and/or backward directions (FBD) in response to forces on the stabilizer 30. However, the locking and the engageable portion may be set so that movements of the right wall 13 continuous with the stabilizer 30 in forward and backward directions FBD can be prevented.

The upper wall 14 has a double-wall structure defined by the inner and outer panels 14A and 14B in the above embodiment. However, the upper wall may have a single-wall structure or a triple-wall structure.

The resilient contact piece 15 extends forward from the rear end of the inner panel 14A in the above embodiment, but it may extend forward from the rear end of the outer panel 14B according to the invention. In this case, the mutual interference of the stabilizer 30 and the insulation barrel 22 in the unfolded state can be avoided by forming the stabilizer 30 between the outer panel 14B and the left wall 13.

The stabilizer 30 has been described as having substantially the same longitudinal extension as the right wall 13 and the upper wall 14. However, the stabilizer may have a different longitudinal extension as compared to the right wall 13 and/or the upper wall 14. This may be achieved, e.g. by a cutout (not shown) provided at one or both longitudinal ends of the blank shown in FIG. 5. Moreover, the stabilizer may be interrupted or divided into two or more stabilizer portions may be provided substantially flush with each other along the forward and backward directions FBD.

It should be understood that two or more stabilizers may be provided in one terminal fitting, preferably by being integrally or unitarily provided between two or more pairs of adjacent walls.

A terminal fitting in accordance with a second embodiment of the invention is illustrated FIGS. 7 to 11. The terminal fitting 1 of this embodiment has a rectangular tubular main portion 10 that extends in forward and backward directions FBD. A wire connection portion 20 is continuous with the rear end of the main portion 10 and a stabilizer 30' projects from the main portion 10. The stabilizer 30' can be inserted into an insertion groove (not shown) formed in an inner surface of a cavity (not shown) to guide the main portion 10 into the cavity. In the following description, reference is made to FIG. 7 concerning vertical and lateral directions.

The wire connection portion 20 includes a wire barrel 21 to be crimped, bent or folded into connection with a core of a wire end (not shown) and an barrel portion 22 to be crimped, bent or folded into connection with an insulated part of the wire end. The insulation barrel 22 is arranged behind the wire barrel 21 and includes two crimping pieces displaced from each other in forward and backward directions FBD.

Figure 7:
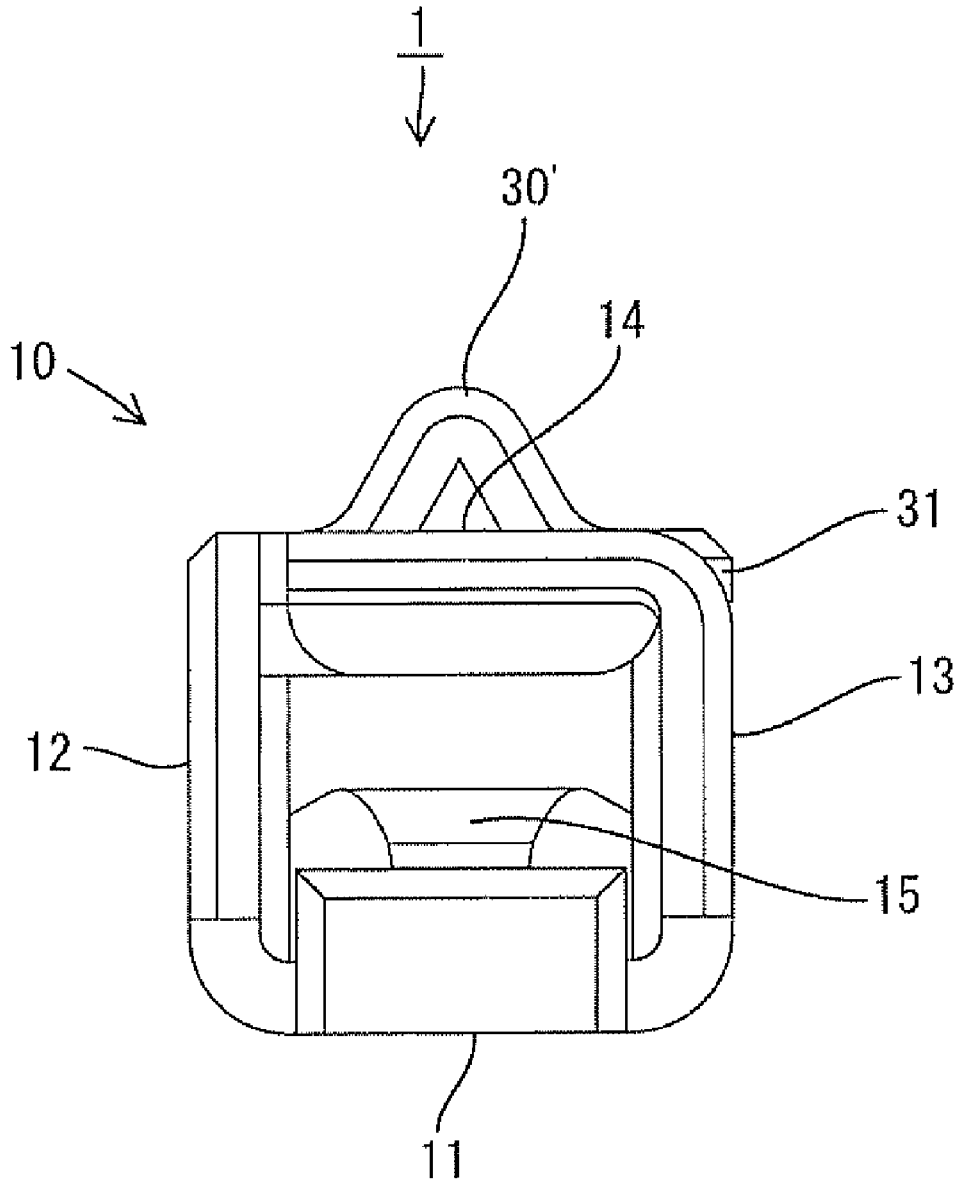
FIG. 7 is a front view when a terminal fitting according to one embodiment is viewed from front.
Figure 8:
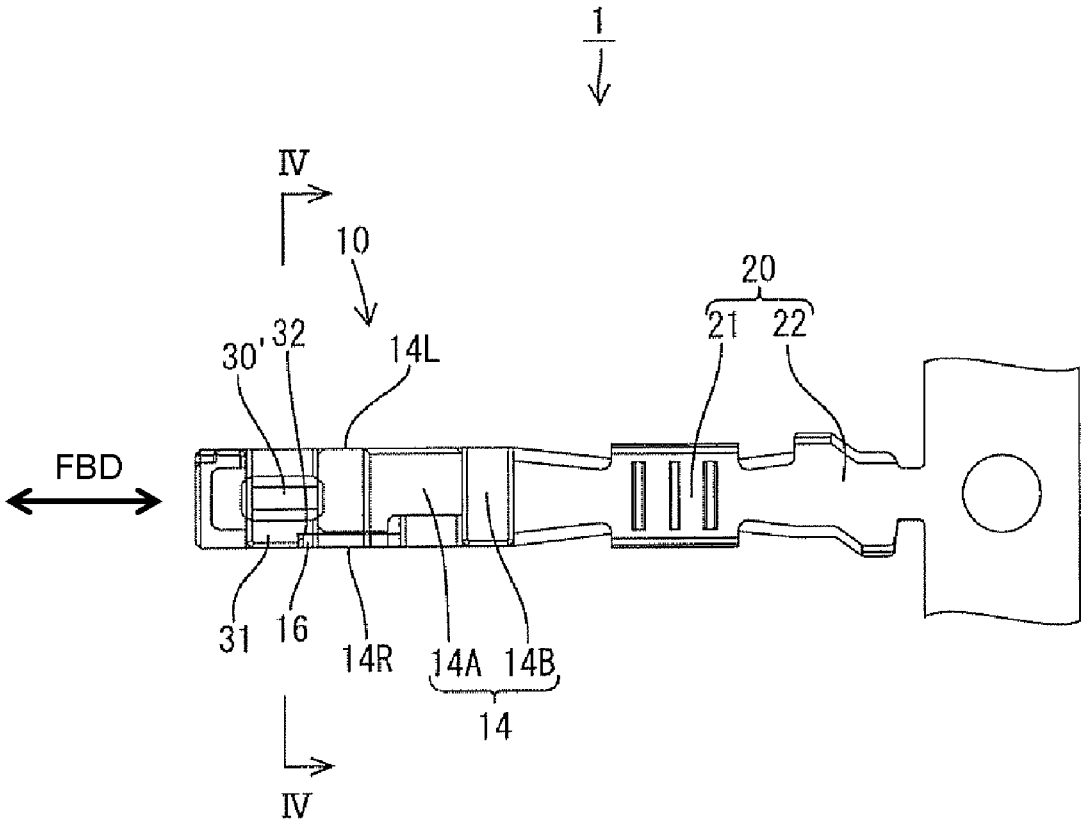
FIG. 8 is a plan view when the terminal fitting is viewed from above.
Figure 9:
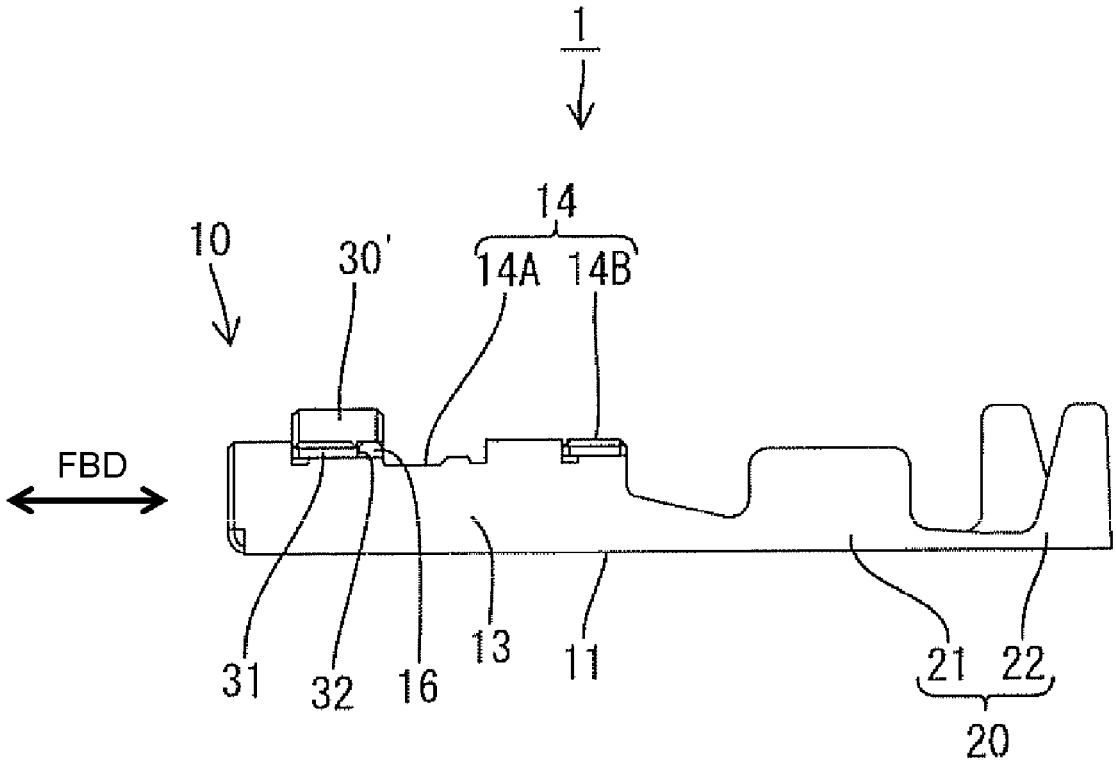
FIG. 9 is a side view when the terminal fitting is viewed sideways.

As shown in FIG. 7, the main portion 10 has a bottom wall 11, a left wall 12 that projects substantially normally up from the left side of the bottom wall 11, a right wall 13 that projects substantially normally up from the right side of the bottom wall 11 and an upper wall 14 arranged between the upper ends of the left and right walls 12 and 13 to face the bottom wall 11. The upper wall 14 has a double wall structure comprised of an inner panel 14A at the inner side of the main portion 10 and an outer panel 14B arranged at the outer side of the main portion 10. The outer panel 14B is arranged outside of the inner panel 14A and can prevent the inner panel 14A from being deformed outwardly.

A resilient contact piece 15 extends forward into the main portion 10 from the rear end of the inner panel 14A and is resiliently deformable up and down in directions intersecting an insertion direction of a mating terminal fitting (not shown). A male tab (not shown) of a mating terminal fitting can be inserted into the open front of the main portion 10 and slides in contact with the resilient contact piece 15 to press the resilient contact piece 15 towards the bottom wall 111. Thus, the male tab is held tightly between the resilient contact piece 15 and the inner wall 14A. In this way, the mating terminal fitting and the terminal fitting 1 are connected electrically.

Figure 11:
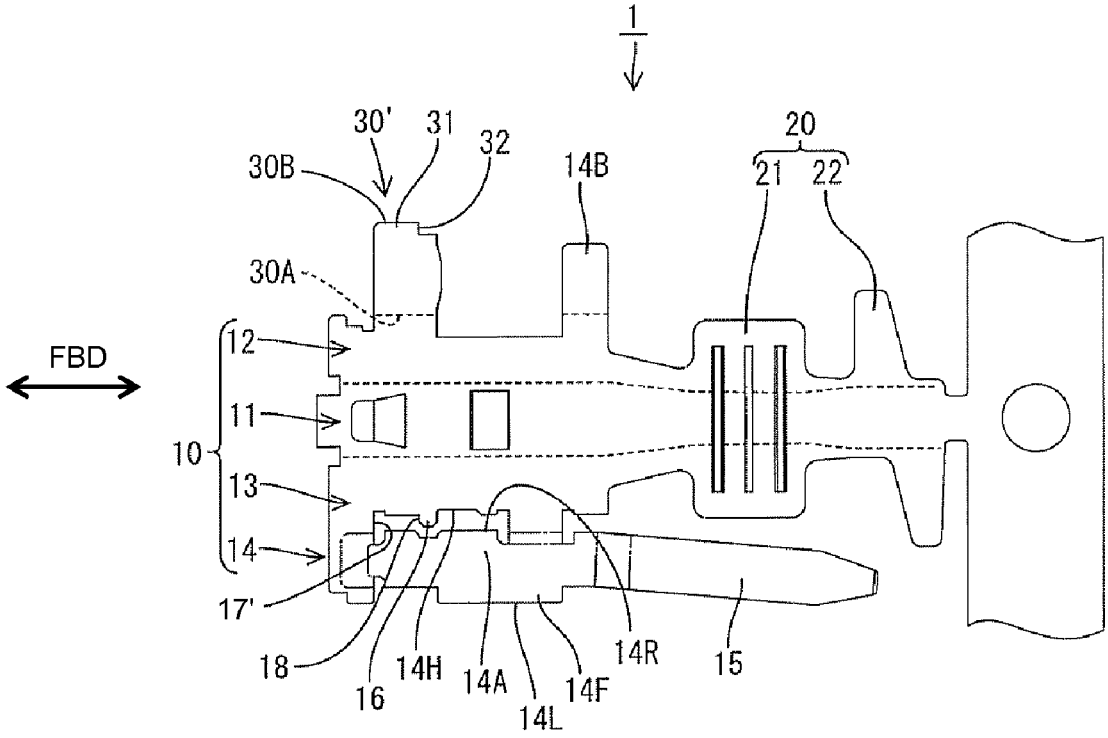
FIG. 11 is a plan view of a blank for forming the terminal fitting of FIGS. 7-10.

As shown in FIG. 11, a long hole 14H penetrates a portion of the inner panel 14A near a right side 14R of the inner panel 14A and extends in substantially forward and backward directions FBD. The inner panel 14A is connected with the right wall 13 at positions near the front and rear ends, by being formed with the long hole 14H. A part of the inner wall 14A behind the front edge of the long hole 14H is recessed inwardly of the main portion 10 by about the plate thickness. Further, a projection 16 is formed at a side of the opening edge of the long hole 14H towards the right wall 13. The rear end of the projection 16 is located before the rear end of the stabilizer 30'. Thus, it is not necessary to form a narrow locking lance to avoid interference with the projection 16 in the case where it is desired to engage the locking lance with the rear end of the stabilizer 3. Therefore a sufficient locking force can be obtained.

The terminal fitting 1 is to be inserted into a waterproof mat seal. Accordingly, the outer peripheral edge of the front surface of the main portion 10 is beveled to prevent the waterproof mat seal from being scratched. The outer peripheral edge of the stabilizer 30' also is beveled. Additionally, the stabilizer 30' is formed with an R-surface by being bent as described herein.

When the terminal fitting 1 of this embodiment is inserted to a substantially proper insertion position in the cavity 11, a locking lance (not shown) provided on the inner surface of the cavity engages the rear end of the stabilizer 30' to prevent the terminal fitting 1 from coming out backward.

Figure 10:
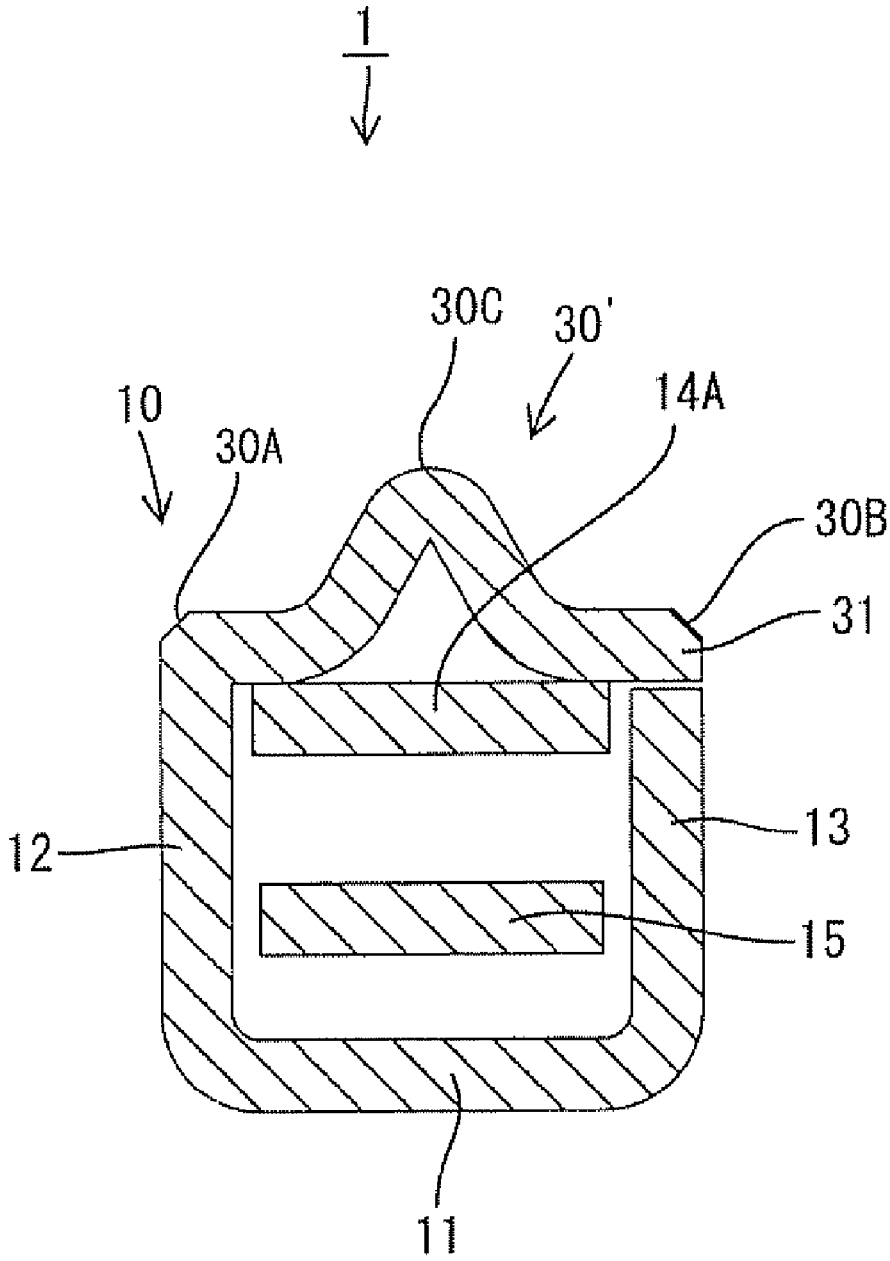
FIG. 10 is a section along IV-IV of FIG. 8.

As shown in FIG. 10, the stabilizer 30' extends obliquely out and up to the right from the upper end of the left wall 12 and is folded at an intermediate position to extend obliquely down and in to the right towards the upper end of the right wall 13. In other words, the stabilizer 30' is supported only at one end by extending up with its side at a left side 14L of the inner panel 14A as a base end 30A and with an extending end 30B arranged at a right side 14R. An upper part of the stabilizer 30' has a fold 30C located at the lateral center of the inner panel 14A. Thus, the stabilizer 30' has a substantially triangular or pointed shape with the fold 30C as a vertex. Accordingly, the terminal fitting 1 can be inserted into a round hole (not shown) of the waterproof mat seal, while minimizing deformation of the round hole.

A lock 31 is defined at the extending end 30B of the stabilizer 30' by forming a cutout 32 is formed at the rear of the lock 31. The lock 31 is fit between a front edge 17' of the long hole 14H and a front edge 18 of the projection 16. Specifically, the front edge of the lock 31 contacts the front edge 17' of the long hole 14H, and the rear edge of the lock 31, i.e. the front edge of the cutout 32 contacts the front edge 18 of the projection 16.

The wire connected with the properly inserted terminal fitting 1 could be pulled backward, and this backward force will urge the stabilizer 30' strongly against the locking lance. However, the engagement of the extending end 30B of the stabilizer 30' prevents a forward movement of the extending end 30B of the stabilizer 30'. Thus, a locking force of the locking lance is increased. The terminal fitting 1 could be pushed into the cavity in a vertically inverted posture, and hence the front end of the stabilizer 30' could contact the rear opening edge of the cavity. However, the engagement of the extending end 30B of the stabilizer 30' prevents the stabilizer 30' from being buckled by this contact.

The terminal fitting 1 is formed by bending, folding and/or embossing the blank shown in FIG. 11. The left wall 12, the stabilizer 30' and the outer panel 14B of the upper wall 14 are continuous with the bottom wall 11, as shown at the upper side in FIG. 11. The right wall 13 and the inner panel 14A of the upper wall 14 are continuous with the bottom wall 11 at a lower side in FIG. 11. The resilient contact piece 15 is arranged behind the inner panel 14A. Further, a bulge 14F that is long in forward and backward directions FBD is formed at the left side 14L of the inner wall 14. The bulge 14F is fit between the rear edge of the base end 30A of the stabilizer 30' and the front edge of the base end of the upper panel 14, thereby preventing movements of the left side 14L of the inner panel 14A in forward and backward directions FBD.

Blanks for forming the terminal fittings 1 of this embodiment are arranged substantially side by side (one after another in the vertical direction in FIG. 11). The resilient contact piece 15 is arranged behind (to the right in FIG. 11) the inner panel 14A and extends obliquely back to avoid the interference with the wire barrel 21 and the insulation barrel 22. Hence, an interval between adjacent terminal fittings 1 can be smaller than in the case where the resilient contact piece is arranged lateral of (below in FIG. 11) the inner panel 14A.

Figure 4:
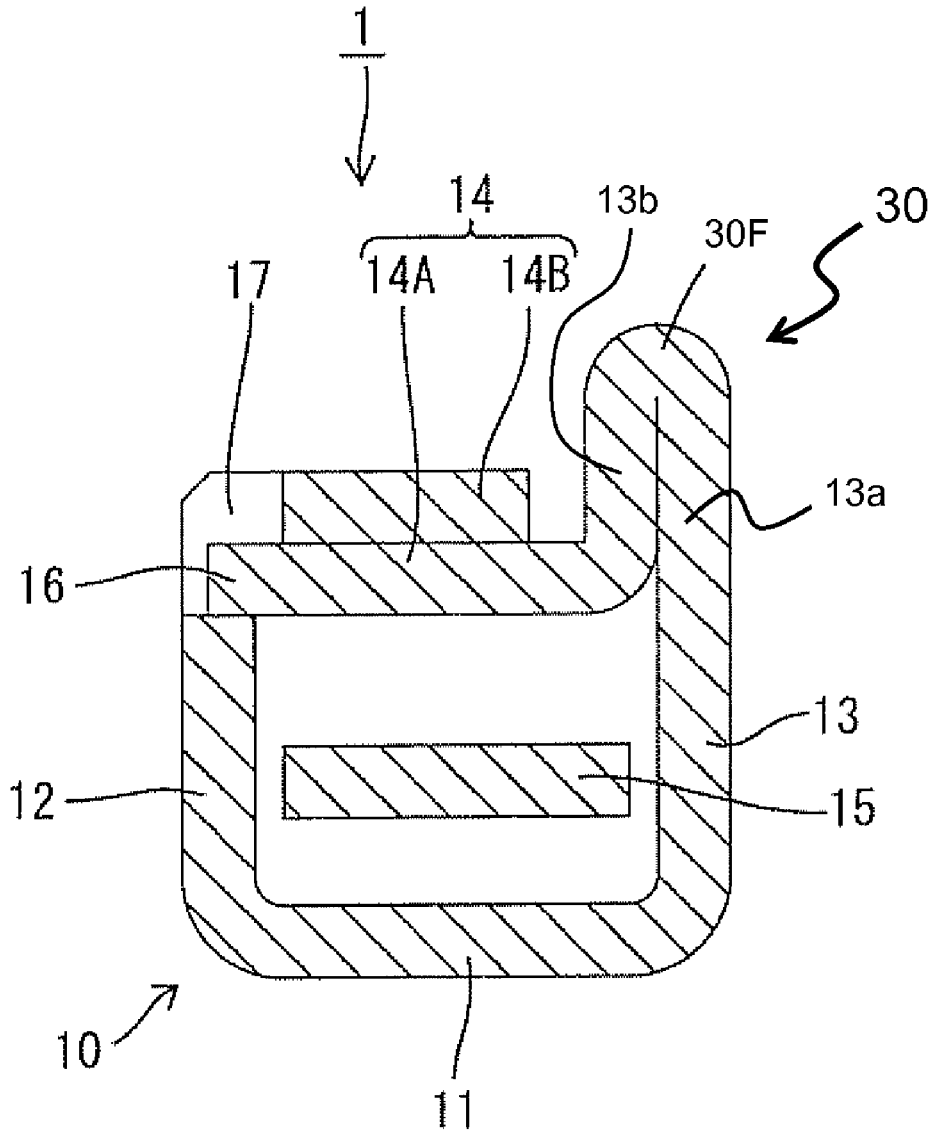
FIG. 4 is a section along IV-IV of FIG. 2.

The terminal fitting 1 is formed by bending, folding and/or embossing the cut or punched-out conductive metal blank of FIG. 11. The left and right walls 12 and 13 are formed by bending parts extending from the opposite left and right sides of the bottom wall 11 to extend substantially normally up while folding the resilient contact piece 15 forward. The inner panel 14A of the upper wall 14 is formed by bending a part extending from the right wall 13 towards the left wall 12. The outer panel 14B of the upper wall 14 and the stabilizer 30' are formed by bending a part extending from the right wall 13 towards the left wall 12. As shown in FIG. 4, the stabilizer 30' extends obliquely up and out to the right from a position near the left side 14L of the inner panel 14 and is folded at the lateral center to extend obliquely down and in to the right towards the right side 14R of the inner wall 14. Thus, the stabilizer 30' has a substantially triangular, pointed or converging shape.

The stabilizer 30' is inserted into the insertion groove in the cavity to guide the insertion of the main portion 10 into the cavity. The locking lance engages the rear end of the stabilizer 30' when the terminal fitting 1 reaches the proper insertion position and retains the terminal fitting 1 in the cavity so as not to come out backward. The terminal fitting 1 could be pushed into the cavity in a wrong orientation (e.g. a vertically inverted posture). As a result, the front end of the stabilizer 30' will contact the rear opening edge of the cavity. However, the rear edge of the lock 31 contacts the front edge 18 of the projection 16 to prevent a backward movement of the extending end 30B of the stabilizer 30' and to prevent the stabilizer 30' from being buckled and deformed.

The wire connected with the terminal fitting 1 could be pulled backward and would cause the rear end of the stabilizer 30' to be pressed strongly against the locking lance. However, the front edge of the lock 31 contacts the front edge 17' of the long hole 14H to prevent a forward movement of the extending end 30B of the stabilizer 30'. Further, the cutout 32 at the rear end of the locking 31 accommodates the projection 16 and the rear edge of the projection 16 is located before the rear end of the stabilizer 30'. Thus, the locking lance need not be made smaller to avoid interference with the projection 16. Thus, a sufficient locking force of the locking lance is ensured so that the terminal fitting 1 will not come out backward from the cavity. The stabilizer 30' of this embodiment has both a guiding function and a retaining function for the terminal fitting 1. Thus, it is not necessary to separately provide structures for these functions and the construction can be simplified.

As described above, the front edge of the lock 31 engages the front edge 17' of the long hole 14H to prevent forward movement of the extending end 30B of the stabilizer 30'. Thus, the stabilizer 30' is supported at both the base end 30A and the extending end 30B to increase the rigidity of the stabilizer 30'. Hence, the engagement of the locking lance with the rear end of the stabilizer 30' provides sufficient locking force for retaining the terminal fitting 1.

The rear edge of the lock 31 of the stabilizer 30' engages the front edge 18 of the projection 16 to prevent backward movement of the lock 31. Thus, the stabilizer 30' will not buckle and deform if the terminal fitting 1 is inserted in an orientation where the front end of the stabilizer 30' contacts the rear opening edge of the cavity.

The rear edge of the projection 16 is before the rear end of the stabilizer 30'. Thus, the locking lance for engaging the stabilizer 30' will not interfere with the projection 16. In other words, the locking lance need not be made smaller to avoid the projection 16 and a large locking force is assured.

The resilient contact piece 15 is behind the inner panel 14A. Thus, the interval between adjacent terminal fittings 1 is smaller than if the resilient contact piece 15 was laterally of the inner panel 14A. Thus the number of terminal fittings 1 taken from a sheet metal is increased to improve a yield.

The invention is not limited to the above described and illustrated embodiment. For example, the following modifications are also embraced by the technical scope of the present invention.

The stabilizer 30' is formed on the upper wall 14 in the above embodiment, but it may be formed on any one of the surrounding walls of the main portion 10, for example, on the outer surface of the right wall 13.

The stabilizer 30' need not perform the function of retaining the terminal fitting 1.

The lock 31 fits into the long hole 14H to prevent movements of the terminal fitting 1 in forward and backward directions FBD in the above embodiment. However, the lock 31 may be an opening and a projection fittable into this opening may be provided at the upper end of the right wall 13.

Although the stabilizer 30' is formed with the upper end edge of the left wall 12 as the base end in the above embodiment, it may extend like a cantilever from the upper end of the right wall 13 as the base end towards the upper end of the left wall 12 according to the present invention.

What is claimed is:

1. A terminal fitting, comprising:

a main portion having a base wall, first and second opposed side walls projecting from opposite sides of the base wall and an outer panel folded from an end of the first side wall remote from the base wall and projecting toward the second side wall, a locking hole being formed in the first side wall substantially adjacent the outer panel; and a stabilizer projecting from the main portion, the stabilizer including a first stabilizer panel extending unitarily from the second side wall of the main portion, a second stabilizer panel unitary with the first stabilizer panel and a fold between the first and second stabilizer panels at a position outward of the main portion, an inner panel folded from an end of the second stabilizer panel opposite the fold and extending into locked engagement with the locking hole of the main portion so that the inner panel is substantially opposed to the base wall inwardly of and substantially adjacent the outer panel.

2. The terminal fitting of claim 1, wherein the inner panel has a lock at an edge of the inner panel substantially opposite the stabilizer, and wherein the locking hole engages the lock in forward and/or backward directions.

3. The terminal fitting of claim 1, wherein the outer panel is in face-to-face engagement with an outer side of the inner panel.

4. The terminal fitting of claim 3, wherein the inner panel is unitary with the stabilizer.

5. The terminal fitting of claim 1, wherein a resilient contact piece is provided in the main portion and is unitary with the inner panel, the resilient contact piece being configured for resiliently contacting a mating terminal fitting.

6. A terminal fitting, comprising:

a main portion having a base wall, first and second opposed side walls projecting from opposite sides of the base wall and an outer panel folded from an end of the first side wall remote from the base wall and projecting toward the second side wall, a locking hole being formed in the first side wall substantially adjacent the outer panel;

a stabilizer projecting from the main portion, wherein the stabilizer has a first side extending unitarily from the first side walls of the main portion and a second side adjacent the second side wall of the main portion, a lock being provided at the second side of the stabilizer, an engageable portion provided at the second side of the wall and being connected with the lock to prevent a forward movement of the second side of the stabilizer.

7. The terminal fitting of claim 6, wherein a backward movement of the second side of the stabilizer is prevented by the engagement of a rear end of the lock with the engageable portion.

8. The terminal fitting of claim 7, wherein the lock includes a cutout at a rear end thereof, the engageable portion includes a projection fit into the cutout for preventing backward movement of the second side of the stabilizer.

9. The terminal fitting of claim 6, wherein a long hole penetrates at the second side edge of the wall, and the engageable portion is formed by an opening edge of the long hole.

10. The terminal fitting of claim 6, wherein the stabilizer has a substantially triangular shape with a fold at a laterally intermediate position of the wall as a vertex.

* * * * *